US011117765B2

(12) United States Patent
Lee et al.

(10) Patent No.: US 11,117,765 B2
(45) Date of Patent: Sep. 14, 2021

(54) PRINTING MEDIUM GUIDE

(71) Applicant: HEWLETT-PACKARD DEVELOPMENT COMPANY, L.P., Spring, TX (US)

(72) Inventors: Seung Sup Lee, Seongnam-si (KR); Hyun Woo Kim, Seongnam-si (KR); Young Kee Cho, Seongnam-si (KR); Yong Jae Kim, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/633,881

(22) PCT Filed: Feb. 28, 2018

(86) PCT No.: PCT/KR2018/002425
§ 371 (c)(1),
(2) Date: Jan. 24, 2020

(87) PCT Pub. No.: WO2019/027116
PCT Pub. Date: Feb. 7, 2019

(65) Prior Publication Data

US 2020/0239253 A1 Jul. 30, 2020

(30) Foreign Application Priority Data

Aug. 1, 2017 (KR) ..... 10-2017-0097833

(51) Int. Cl.
*B65H 5/36* (2006.01)
*B65H 5/06* (2006.01)

(52) U.S. Cl.
CPC ..... *B65H 5/36* (2013.01); *B65H 5/062* (2013.01); *B65H 2402/31* (2013.01)

(58) Field of Classification Search
CPC .. B65H 5/36; G03G 21/1623; G03G 21/1638; G03G 21/1628; G03G 21/1633
(Continued)

(56) References Cited

U.S. PATENT DOCUMENTS 5,988,635 A * 11/1999 Ohshima ..... B65H 5/06 271/109
6,550,907 B2 * 4/2003 Uchida ..... B41J 13/0027 347/104
(Continued)

FOREIGN PATENT DOCUMENTS

CN 104302484 A 1/2015
CN 106044308 A 10/2016
(Continued)

OTHER PUBLICATIONS

Machine translation of JP2-86522.*

*Primary Examiner* — Thomas A Morrison
(74) *Attorney, Agent, or Firm* — Jefferson IP Law, LLP

(57) ABSTRACT

An image forming apparatus is provided. The image forming apparatus includes a paper-feed unit, a developing unit to form an image in a printing medium, an insertion unit including first and second rollers configured to insert the printing medium conveyed from the paper-feed unit into the developing unit, and a guide unit rotatably disposed about a rotation shaft of the first roller and configured to guide the printing medium moving from the paper-feed unit to the insertion unit and selectively press the first roller to the second roller.

20 Claims, 8 Drawing Sheets

(58) Field of Classification Search
USPC ..... 271/272–274, 264
See application file for complete search history.

(56) References Cited

U.S. PATENT DOCUMENTS

| | | | | |
|---|---|---|---|---|
| 2008/0310906 | A1 | 12/2008 | Yang | |
| 2013/0293656 | A1 | 11/2013 | Anami | |
| 2016/0306314 | A1* | 10/2016 | Suto | G03G 15/6529 |
| 2016/0340135 | A1* | 11/2016 | Lee | B65H 5/38 |
| 2017/0151815 | A1 | 6/2017 | Masunaga | |
| 2017/0305712 | A1* | 10/2017 | Ogata | B65H 43/00 |

FOREIGN PATENT DOCUMENTS

| | | | | |
|---|---|---|---|---|
| EP | 0 838 419 | A1 | | 4/1998 |
| EP | 3 098 666 | A1 | | 11/2016 |
| JP | 1-104546 | A | | 4/1989 |
| JP | 2-86522 | | * | 2/1990 |
| JP | 2016-177093 | A | | 10/2016 |
| KR | 20-2000-0000068 | U | | 1/2000 |
| KR | 10-2003-0059958 | A | | 7/2003 |
| KR | 10-2015-0034479 | A | | 4/2015 |
| KR | 10-2017-0084540 | A | | 7/2017 |

* cited by examiner

[Fig. 1]
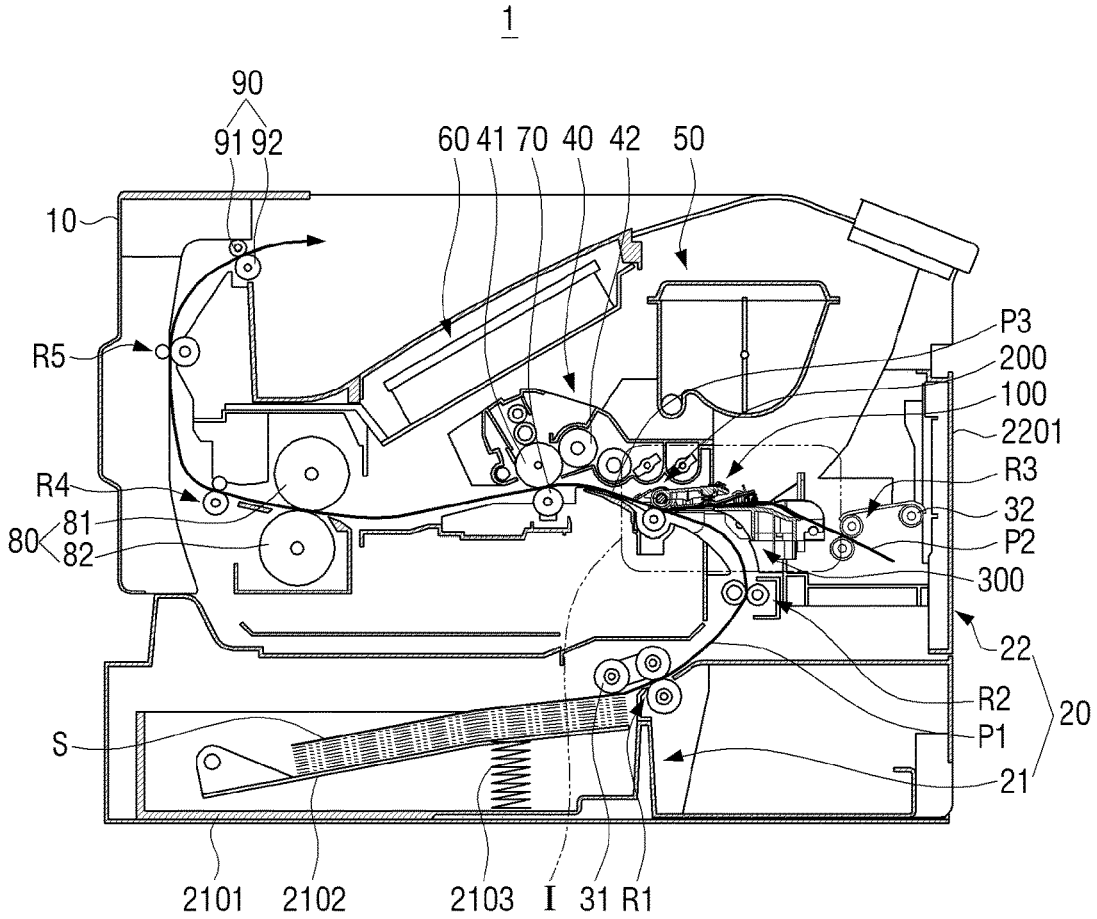
[Fig. 2]
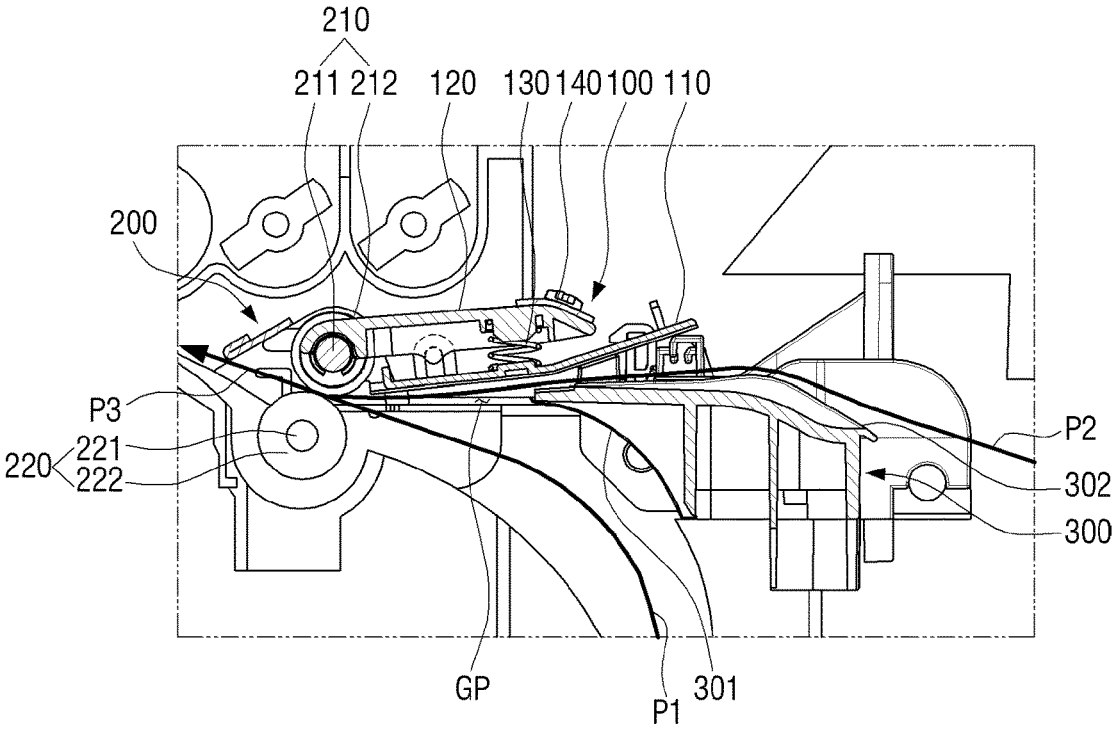

[Fig. 3]
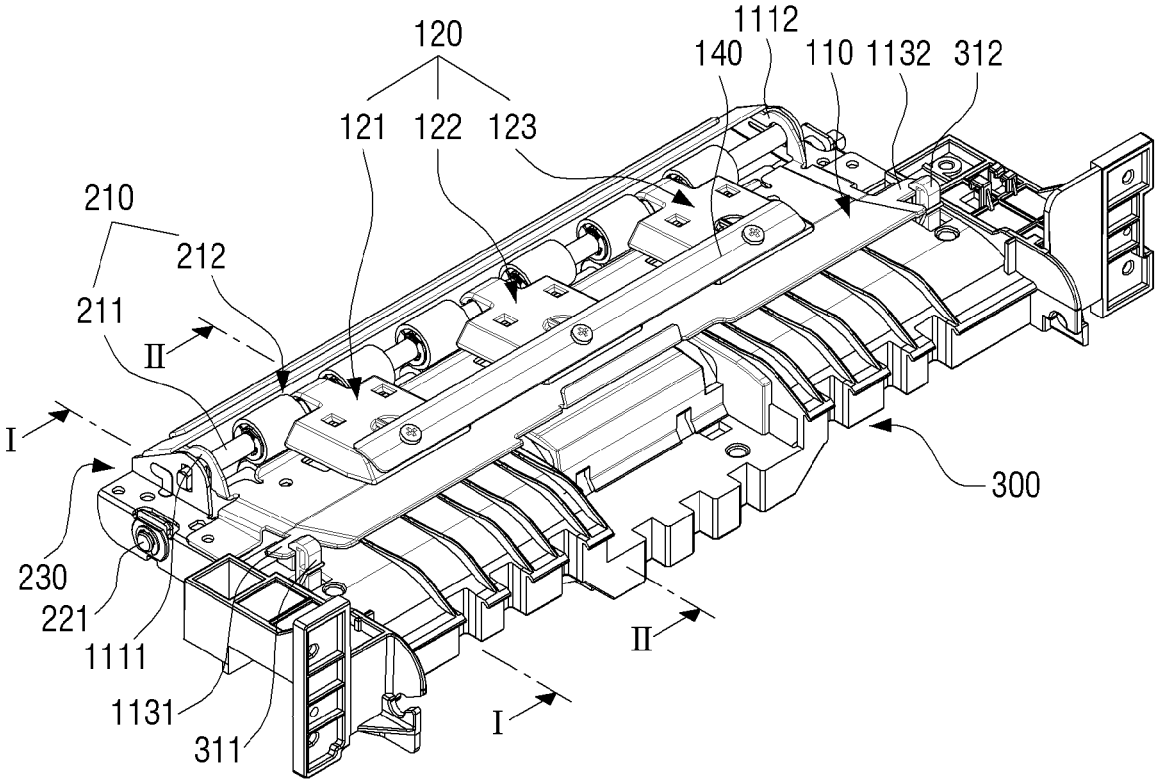

[Fig. 4]
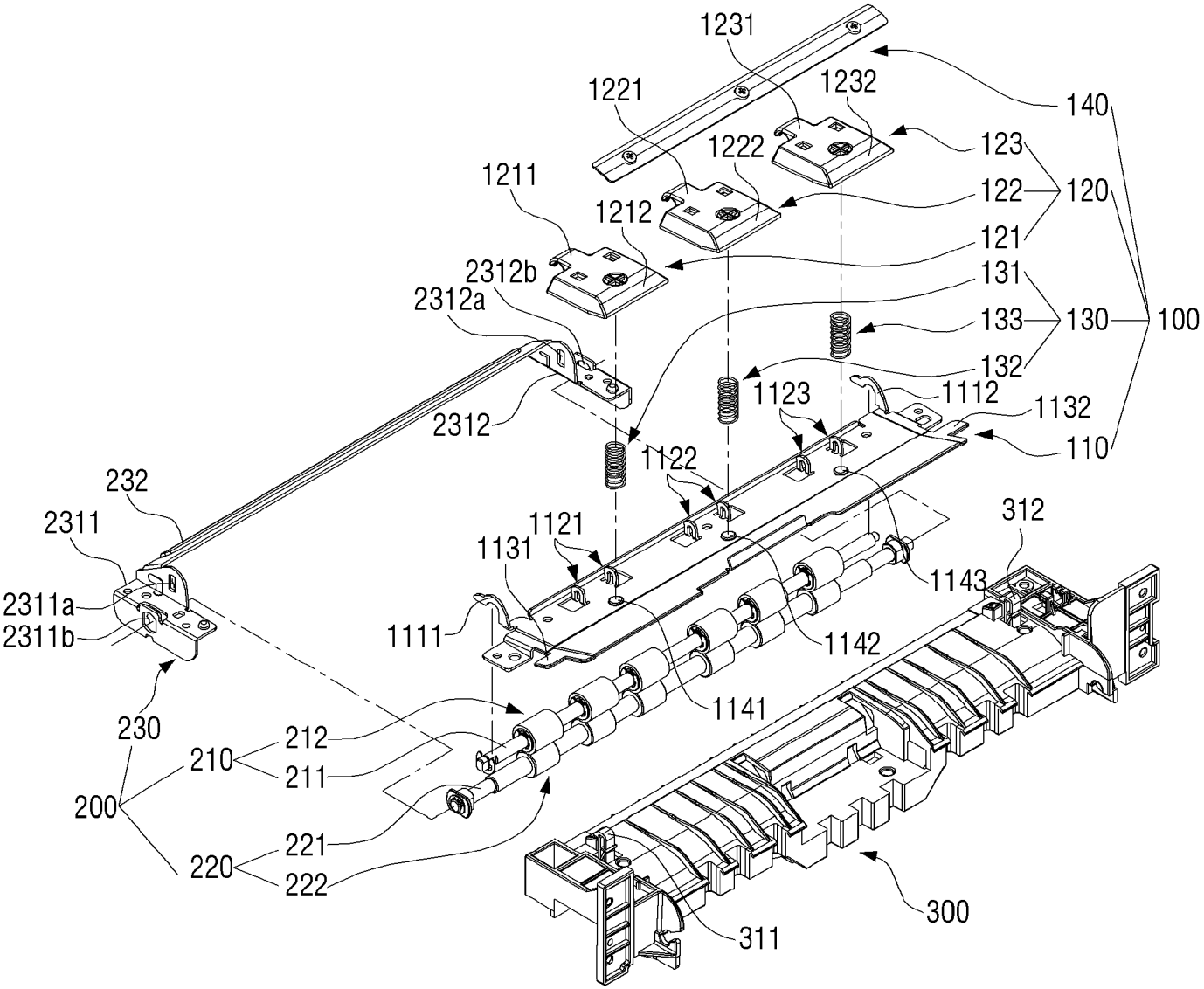

[Fig. 5]
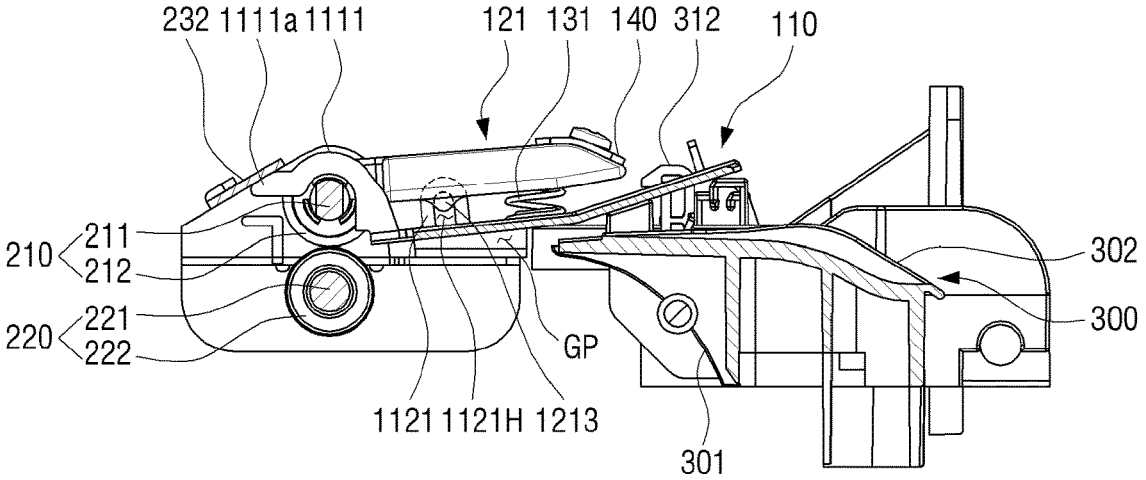
[Fig. 6]
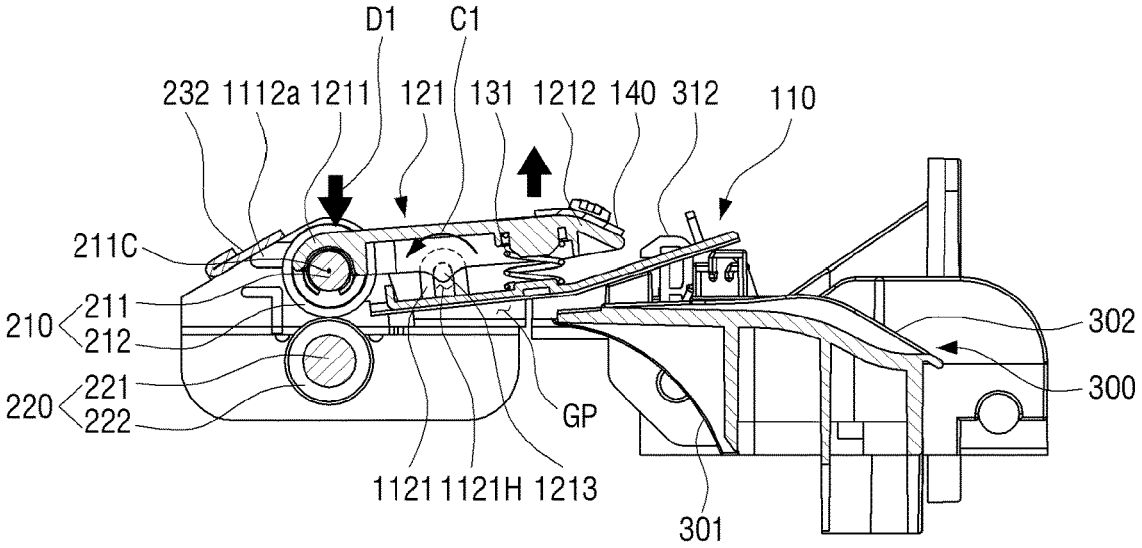
[Fig. 7A]
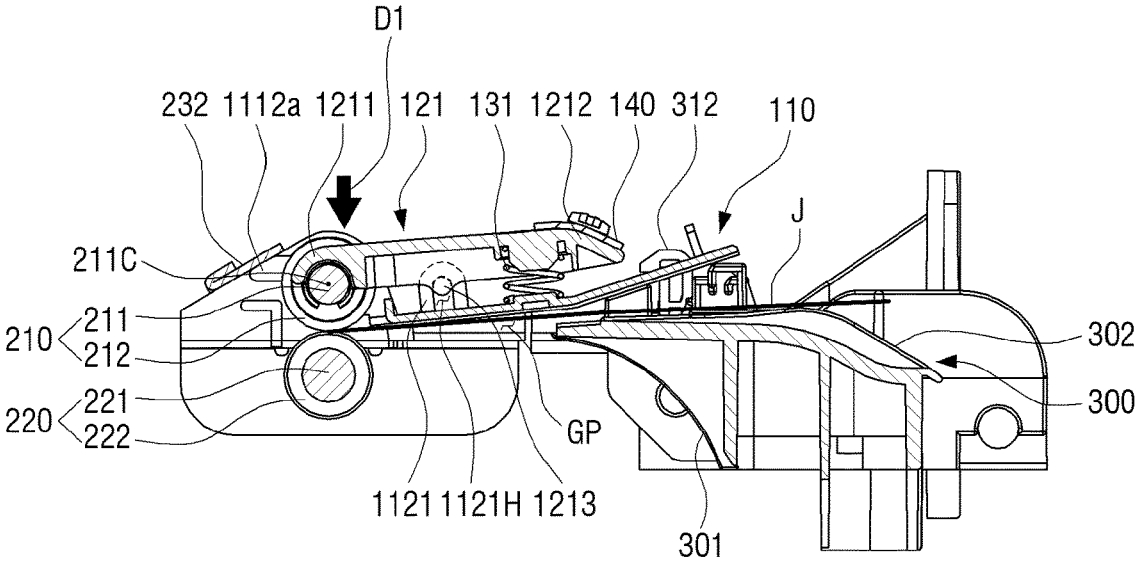

[Fig. 7B]
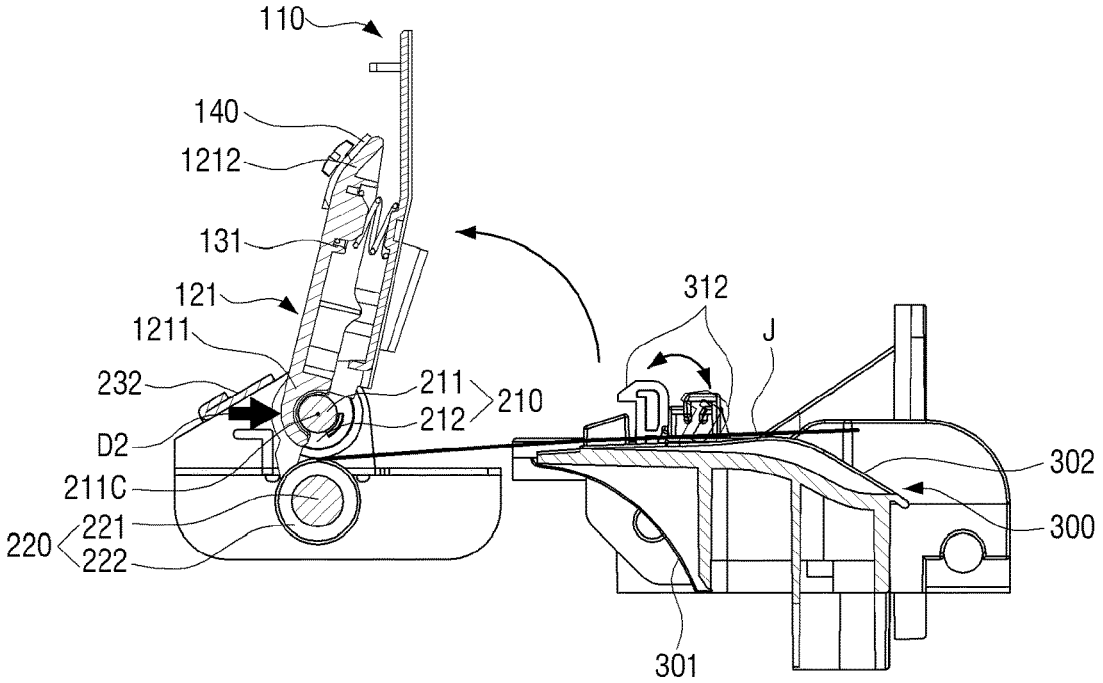
[Fig. 8A]
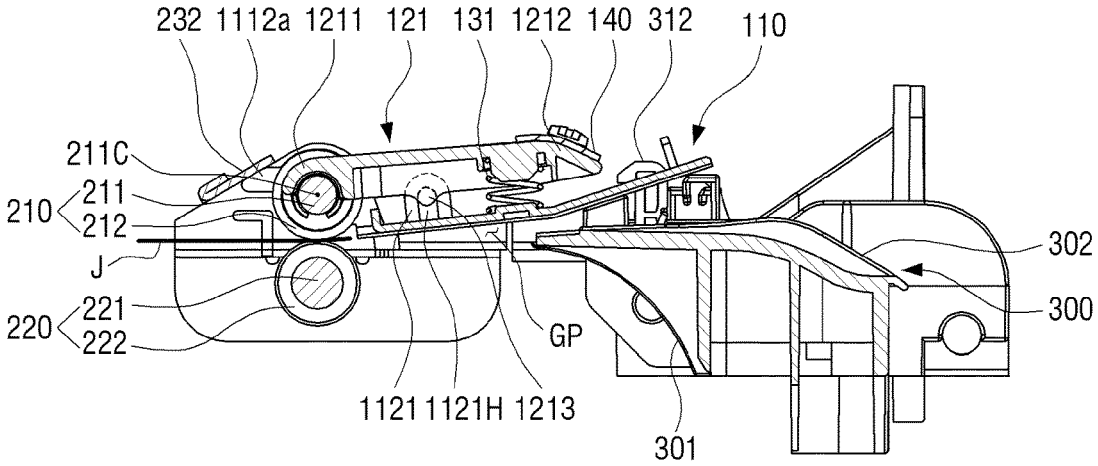
[Fig. 8B]
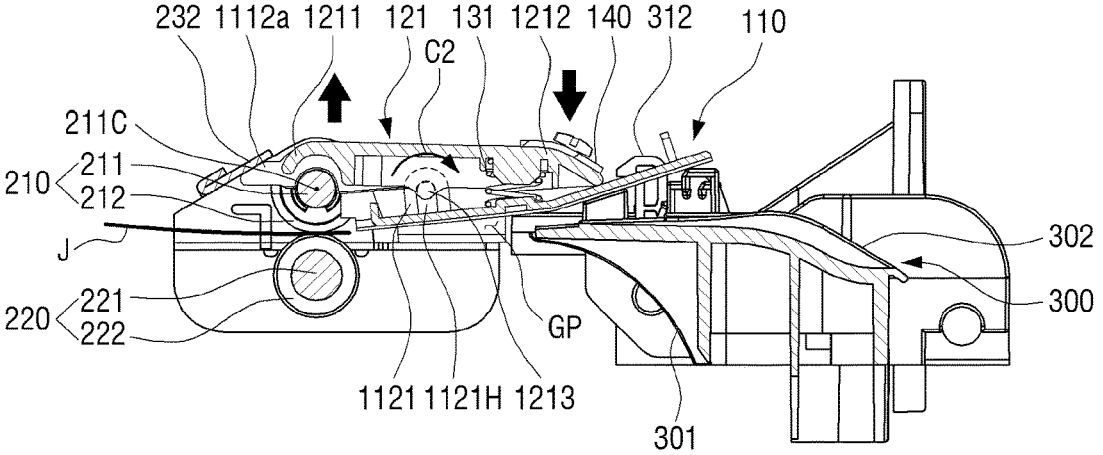

[Fig. 9A]
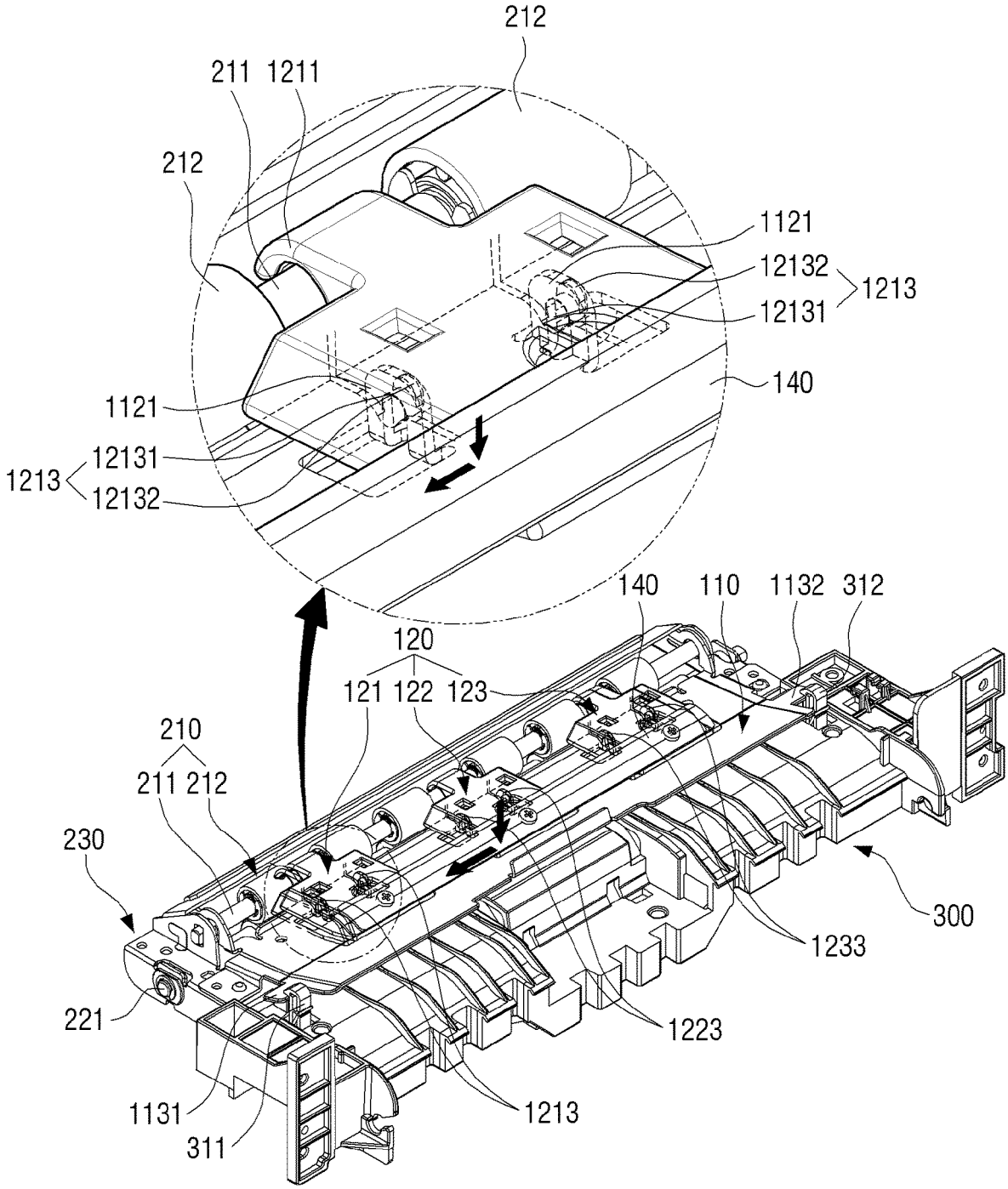

[Fig. 9B]
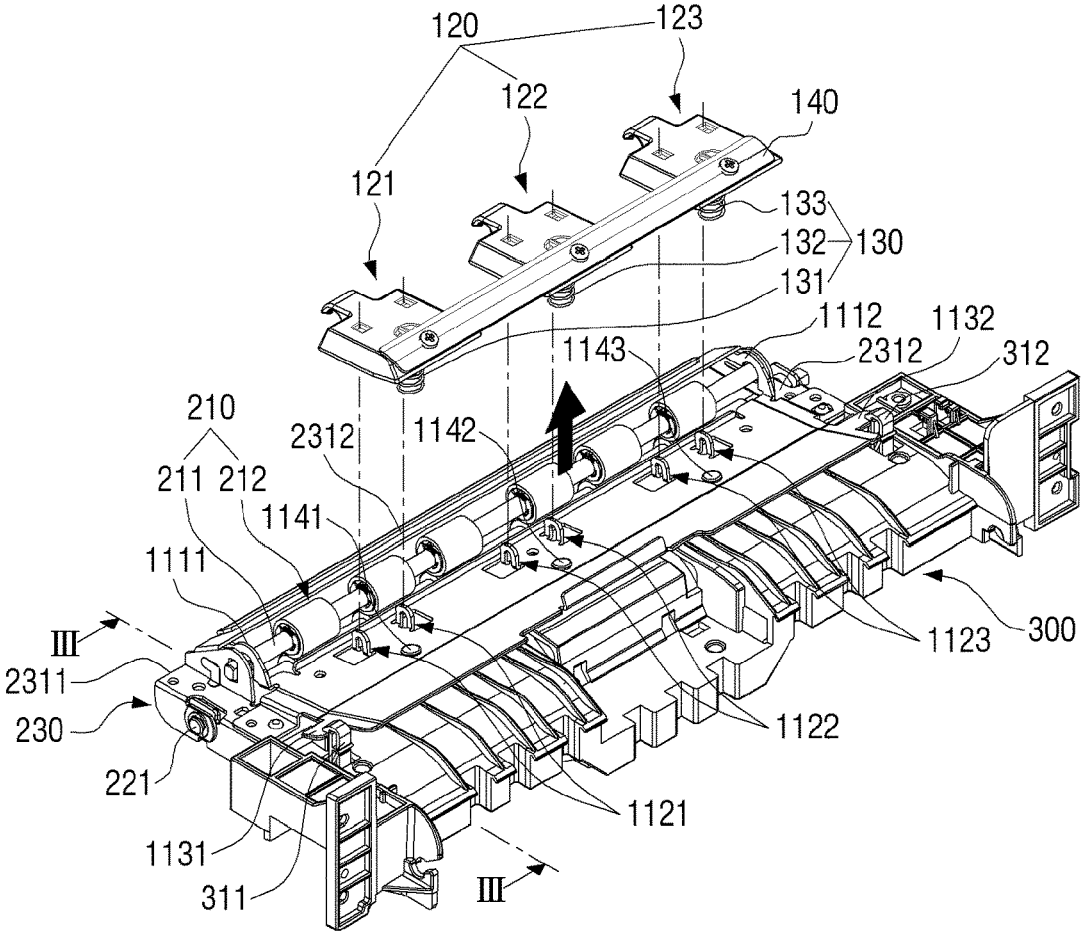
[Fig. 9C]
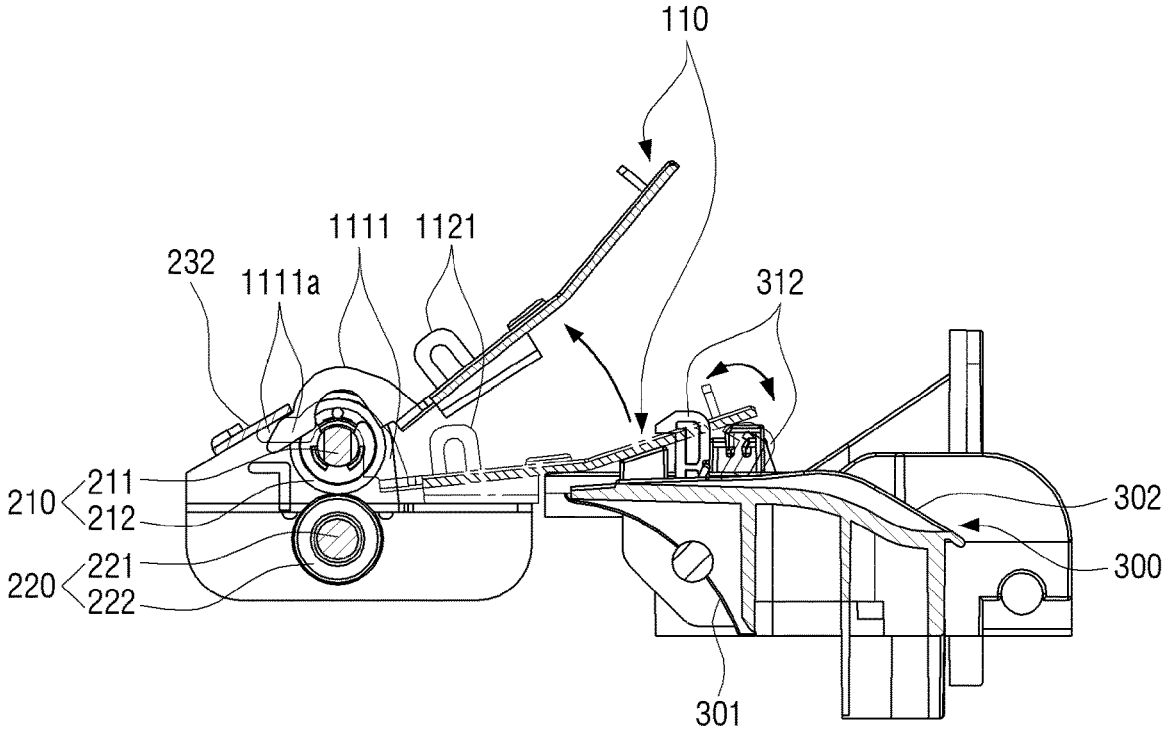

[Fig. 9D]
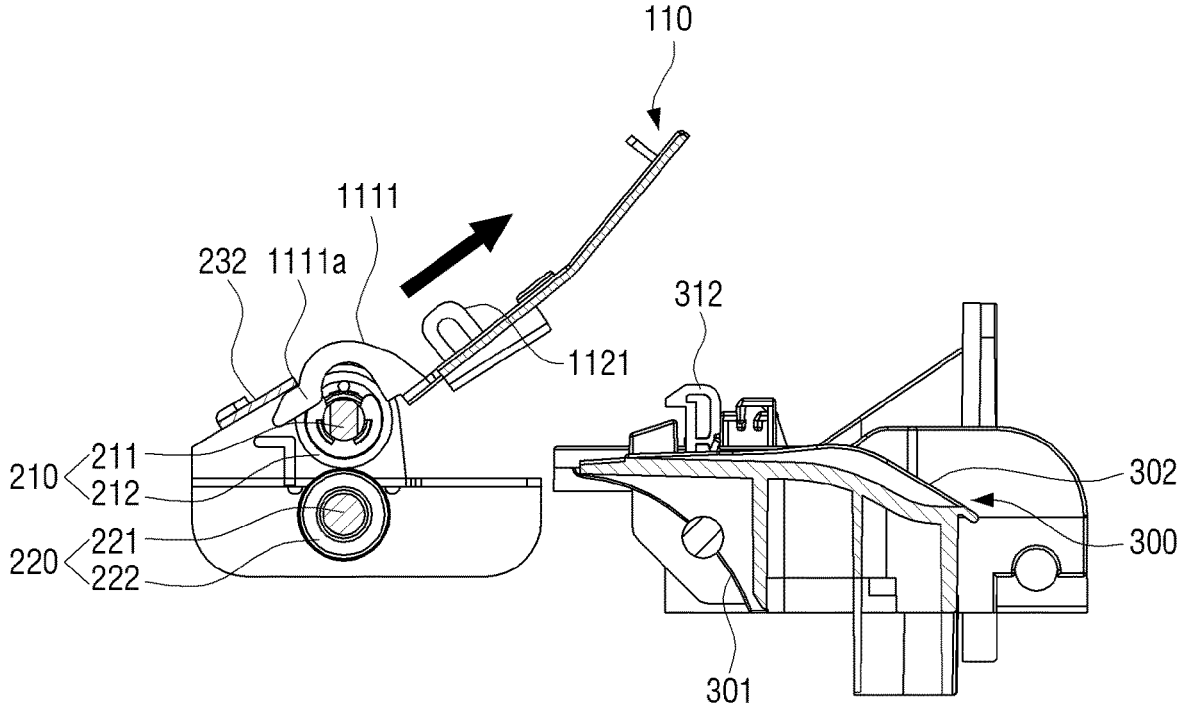

PRINTING MEDIUM GUIDE

BACKGROUND ART

Image forming apparatuses may refer to apparatuses which print an input image signal onto a printing medium through a developing unit and include a printer, a copier, a facsimile, a multifunction peripheral (MFP), etc., in which functions of the printer, the copier, and the facsimile are integrated into one apparatus, and the like.

A general image forming apparatus may include a paper-feed unit configured to supply a printing medium to a developing unit. The printing medium loaded into the paper-feed unit may move to the developing unit through a conveying unit configured by a plurality of rollers along a conveying path.

The printing medium moved from the paper-feed unit to the developing unit may be inserted into the developing unit through an insertion unit disposed close to the developing unit and the printing medium in which an image is formed through the developing unit may pass through a fixing unit and a discharge unit and thus a printing is completed.

DISCLOSURE OF INVENTION

Brief Description of Drawings

The above and/or other aspects of the present disclosure will be more apparent by describing examples of the present disclosure with reference to the accompanying drawings, in which:

FIG. 1 is a schematic diagram illustrating the inside of an image forming apparatus according to an example;

FIG. 2 is an enlarged view of portion I illustrated in FIG. 1 according to an example;

FIG. 3 is a perspective view illustrating a guide unit, an insertion unit, and a conveying guide member illustrated in FIG. 2 according to an example;

FIG. 4 is an exploded perspective view illustrating the guide unit, the insertion unit, and the conveying guide member illustrated in FIG. 3 according to an example;

FIG. 5 is a cross-sectional diagram illustrating the guide unit, the insertion unit, and the conveying guide member taken along line I-I of FIG. 3 according to an example;

FIG. 6 is a cross-sectional diagram illustrating the guide unit, the insertion unit, and the conveying guide member taken along line II-II of FIG. 3 according to an example;

FIG. 7A is a diagram illustrating an example in which a printing medium entered the insertion unit is jammed in a state in which a guide unit is located in a first position;

FIG. 7B is a diagram illustrating an example in which the guide unit illustrated in FIG. 7A rotates about a first rotation shaft of a first roller and is located in a second position;

FIG. 8A is a diagram illustrating an example in which a printing medium passing through an insertion unit is caught;

FIG. 8B is a diagram illustrating an example in which a coupling plate illustrated in FIG. 8A is pressed;

FIG. 9A is a perspective view illustrating a process of separating a nip forming member from a guide plate illustrated in FIG. 3 according to an example;

FIG. 9B is a perspective view illustrating an example in which the nip forming member illustrated in FIG. 9A is separated from the guide plate;

FIG. 9C is a cross-sectional diagram illustrating an example in which the guide plate, from which the nip forming member is separated, rotates taken along line III-III of FIG. 9B; and FIG. 9D is a cross-sectional diagram illustrating a process of separating the guide plate illustrated in FIG. 9C from an insertion unit according to an example.

MODE FOR THE INVENTION

Hereinafter, examples are described in greater detail with reference to the accompanying drawings. The matters defined in the description, such as detailed construction and elements, are provided to assist in a comprehensive understanding of examples. Thus, it is understood that the examples can be carried out without those specifically defined matters.

Various examples will now be described more fully with reference to the accompanying drawings in which some embodiments are shown. The techniques described herein are exemplary, and should not be construed as implying any particular limitation on the present disclosure. It should be understood that various alternatives, combinations and modifications could be devised by those skilled in the art. In the following description, unless otherwise described, the same reference numerals are used for the same elements when they are depicted in different drawings. In the drawings, sizes of elements may be enlarged and a ratio between the elements may be exaggerated or reduced for clarity.

FIG. 1 is a schematic diagram illustrating the inside of an image forming apparatus according to an example.

Referring to FIG. 1, an image forming apparatus 1 may be implemented with a printer, a copier, a scanner, a facsimile, and the like and the image forming apparatus 1 may be a multifunction peripheral (MFP) in which functions of the printer, the copier, the scanner, and the facsimile are integrated into one apparatus.

As illustrated in FIG. 1, the image forming apparatus 1 may include a main body 10 which forms an outer appearance of the image forming apparatus 1, a paper-feed unit 20 for storage and supply of printing media, first and second pick-up rollers 31 and 32 to pick up printing media loaded into the paper-feed unit 20 one by one, a plurality of conveying rollers R1 to R5 to convey the printing media picked up through the first and second pick-up rollers 31 and 32 along a conveying path, a developing unit 40 to form an image in the printing medium supplied through the paper-feed unit 20, a toner unit 50 to supply toner to the developing unit 40, an exposure unit 60 to form an electrostatic latent image in a photoreceptor 41 of the developing unit 40, a transfer roller 70 to transfer a toner image of the photoreceptor 41 into the printing medium, a fixing unit 80 to fix the image formed in the printing medium, and a discharge unit 90 to discharge the printing medium, on which the image formation is completed, to the outside of the main body 10.

The paper-feed unit 20 may include a cassette type of first paper-feed unit 21 detachably coupled to a bottom of the main body 10 and a multipurpose (MP) tray type of second paper-feed unit 22 rotatably coupled to one side of the main body 10 to manually supply the printing medium.

The first paper-feed unit 21 may include a cassette main body 2101 detachably coupled to the bottom of the main body 10 to be opened/closed and including a receiving space, into which printing media S are loaded, in an inside thereof, a knock-up plate 2102 having one end thereof rotatably coupled in the receiving space of the cassette main body 2101 and supporting the printing media, and a knock-up elastic member 2103 to support the other end of the knock-up plate 2102.

The first pick-up roller 31 may be disposed in an upper side of the other end of the knock-up plate 2102.

The knock-up plate 2102 may elastically support the loaded printing media toward the first pick-up roller 31 through an elastic force of the knock-up elastic member 2103 and the first pick-up roller 31 may pick up the printing media loaded into the knock-up plate 2102 one by one.

The plurality of conveying rollers R1 to R5 may be disposed in the inside of the main body 10. Each of the plurality of conveying rollers R1 to R5 may be implemented as a pair of rollers.

The printing medium picked up through the first pick-up roller 31 may be conveyed to the developing unit 40 along a first conveying path P1 through the first conveying roller R1 disclosed close to the first pick-up roller 31.

The printing medium conveyed through the first conveying roller R1 may pass through the second conveying roller R2 and may be conveyed to the developing unit 40 through a conveying guide member 300, a guide unit 100, and an insertion unit 200.

The second paper-feed unit 22 may include a tray main body 2201 rotatably coupled to the one side of the main body 10.

In response to the one side of the main body 10 being opened through rotation of the tray main body 2201, printing media (not shown) may be loaded into the tray main body 2201 and the loaded printing media may be picked up one by one through the second pick-up roller 32.

The printing medium picked up through the second pick-up roller 32 may be conveyed to the developing unit 40 along a second conveying path P2.

For example, the printing medium picked up through the second pick-up roller 32 may pass through the conveying guide member 300, the guide unit 100, and the insertion unit 200 through the third conveying roller R3 disposed close to the second pick-up roller 32 and may be conveyed to the developing unit 40.

The first conveying path P1 and the second conveying path P2 described above may be merged as a third conveying path P3 in the insertion unit 200. The printing medium, which passes through the insertion unit 200, may be supplied to the developing unit 40 along the third conveying path P3.

For example, the paper-feed unit 20 described above may be implemented as three or more paper-feed units in addition to the first and second paper-feed units 21 and 22. In another example, the paper-feed unit 20 may be implemented as a single paper-feed unit.

The developing unit 40 may include the photoreceptor 41 rotatably disposed and a developing roller 42 to transfer toner to the photoreceptor 41.

The toner unit 50 may be coupled to the developing unit 40 and may receive and store the toner for forming an image in the printing medium and supply the toner to the developing unit 40 in response to the printing job being performed.

The exposure unit 60 may form an electrostatic latent image in a surface of the photoreceptor 41 by radiating light including image information into the photoreceptor 41.

The developing roller 42 may form a toner image in the photoreceptor 41 by supplying the toner to the photoreceptor 41 in which the electrostatic latent image is formed.

Accordingly, the visible toner image may be formed in the surface of the photoreceptor 41.

A structure in which the photoreceptor 41 and the developing roller 42 are implemented as one photoreceptor and one developing roller and thus a single color of toner image is formed in the photoreceptor 41 has been illustrated in FIG. 1 as an example. However, this should not be considered limiting. The developing roller 42 may be implemented as four developing rollers including toners having cyan (C), magenta (M), yellow (Y), and black (K) colors and the photoreceptors may also be implemented as four photoreceptors corresponding to the four developing rollers. Accordingly, the visible toner images having the C, M, Y, and K colors may be formed in surfaces of the four photoreceptors. Thus, a color toner image may be formed in the printing medium.

The transfer roller 70 may be rotatably disposed to be in contact with the photoreceptor 41 and a transfer nip may be formed between the transfer roller 70 and the photoreceptor 41.

The printing medium may pass through the transfer nip formed between the photoreceptor 41 and the transfer roller 70 which are rotated. Accordingly, the toner image formed in the photoreceptor 41 may be transferred to the printing medium.

The fixing unit 80 may include first and second rollers 81 and 82. The fixing unit 80 may fix the toner image transferred to the printing medium by pressing and heating the printing medium which passes between the rotating first and second fixing rollers 81 and 82.

For example, the first fixing roller 81 may be implemented as a heating roller which heats the printing medium and the second fixing roller 82 may be implemented as a pressing roller which presses the first fixing roller 81 to be rotatably driven. The first fixing roller 81 may include a heat source such as a halogen lamp and the like in the inside thereof. The first fixing roller 81 may have a belt structure other than a roller shape.

The discharge unit 90 may include first and second discharge rollers 91 and 92. The printing medium in which the toner image is fixed through the fixing unit 80 may pass between the rotating first and second discharge rollers 91 and 92 and may be discharged to the outside of the image forming apparatus 1.

As illustrated in FIG. 1, the fourth and fifth conveying rollers R4 and R5 may be disposed between the fixing unit 80 and the discharge unit 90 and may convey the printing medium which passes through the fixing unit 80 along the third conveying path P3.

The first to fifth conveying rollers R1 to R5 have been illustrated in FIG. 1 as an example, but the number of conveying rollers which convey the printing medium is not limited thereto and the number of conveying rollers may be less than five or greater than five.

The paper-feed unit 20, the first and second pick-up rollers 31 and 32, the developing unit 40, the toner unit 50, the transfer unit 70, the fixing unit 80, and the discharge unit 90 in the above-described image forming apparatus 1 may be the same as or similar to those of the image forming apparatus in the related art. Thus, a detailed description thereof will be omitted.

FIG. 2 is an enlarged diagram of portion I illustrated in FIG. 1 according to an example.

Hereinafter, a structure in which the printing media, conveyed from the first and second paper-feed units 21 and 22, move to the developing unit 40 through the first and second paths P1 and P2 will be described with reference to FIGS. 1 and 2.

Referring to FIG. 2, the printing media, which move to the developing unit 40 through the first and second paths P1 and P2, may be inserted to the developing unit 40 through the insertion unit 200 including a first roller 210 and a second roller 220.

For example, the insertion unit 200 may be disposed close to the developing unit 40 and may insert the printing media, which move to the developing unit 40 from the paper-feed unit 20, into the developing unit 40 one by one.

The insertion unit 200 may include the first and second rollers 210 and 220 which rotate in a contact state with each other. The printing medium conveyed from the paper-feed unit 20 may pass between the rotating first and second rollers 210 and 220 and move to the developing unit 40.

The first and second rollers 210 and 220 may include a first rotation shaft 211 and a second rotation shaft 221 and at least one first roller member 212 and at least one second roller member 222 which are rotatably coupled to the first rotation shaft 211 and the second rotation shaft 221.

The insertion unit 200 including the first and second rollers 210 and 220 may align the printing media conveyed from the paper-feed unit 20 and insert the aligned printing media into the developing unit 40 by rotating and stopping the first and second rollers 210 and 220.

For example, the first and second rollers 210 and 220 may align front ends of the printing media conveyed through the first and second paper-feed unit 21 and 22 in a stopped state and the first and second rollers 210 and 220 may rotate and insert the aligned printing media to the developing unit 40.

The insertion unit 200, which aligns the printing medium conveyed from the paper-feed unit 20 and inserts the aligned printing medium into the developing unit 40, may refer to a registration unit and the first and second rollers 210 and 220 may refer to first and second registration rollers 210 and 220.

The insertion unit 200 including the first and second rollers 210 and 220 may be disposed in various positions in the inside of the main body 10 and convey the conveyed printing medium. That is, the insertion unit 200 including the first and second rollers 210 and 220 may be disposed in various positions other than the structure in which the insertion unit 200 is disposed close to the developing unit 40 and inserts the aligned orienting medium into the developing unit 40.

As described above, the paper-feed unit 20 may include the first and second paper-feed units 21 and 22.

Printing media loaded into the first and second paper-feed units 21 and 22 may move along different conveying paths from each other. The printing media may move to the developing unit 40 through the first and second conveying paths P1 and P2.

For example, the printing media, which move through the first and second conveying paths P1 and P2, may move toward the conveying guide member 300 and may be conveyed to the insertion unit 200 through the conveying guide member 300 and the guide unit 100.

In this example, the printing media, which move along the first and second conveying paths P1 and P2, may be guided through the conveying guide member 300. Thus, the conveying direction of the printing media may be changed toward the developing unit 40. The printing media, which move along the conveying guide member 300, may be guided through the guide unit 100 and may be smoothly conveyed to the insertion unit 200.

The printing media conveyed to the insertion unit 200 may pass through the first and second rollers 210 and 220 and may be inserted into the developing unit 40 along the third path P3.

For example, the first and second paths P1 and P2 may be merged between the first and second rollers 210 and 220 as the third path P3.

The conveying guide member 300 may include a first guide surface 301 which guides the printing medium moving from the first paper-feed unit 21 along the first conveying path P1 and a second guide surface 302 which guides the printing medium moving from the second paper-feed unit 22 along the second conveying path P2.

One end of the first and second guide surfaces 301 and 302, which are close to the insertion unit 200 may be disposed close to each other so that the printing media moving along the first and second guide surfaces 301 and 303 may be conveyed to a side facing the insertion unit 200.

As illustrated in FIG. 2, the first and second guide surfaces 301 and 302 may have a curved shape which allows the printing media conveyed from the first and second paper-feed units 21 and 22 to be guided in a direction facing the insertion unit 200.

The first guide surface 301 may be disposed in a lower side of the conveying guide member 300 and the second guide surface 302 may be disposed in an upper side of the conveying guide member 300. However, the shapes of the conveying guide member 300 and the first and second guide surfaces 301 and 302 may be changed to various shapes other than the curved shape illustrated in FIG. 2.

The conveying guide member 300 may be disposed to be spaced at a certain interval from the insertion unit 200.

The guide unit 100 may be disposed between the conveying guide member 300 and the insertion unit 200 and may guide the printing medium conveyed from the conveying guide member 300 to the insertion unit 200.

The guide unit 100 may rotate about the rotation shaft 211 of the first roller 210 to be described later and selectively form or open the guide path GP which guides the printing medium conveyed from the conveying guide member 300 to the insertion unit 200.

As illustrated in FIG. 2, the guide unit 100 may be disposed in an upper side of the second guide surface 302 between the insertion unit 200 and the conveying guide member 300.

For example, the printing medium moving along the first guide surface 301 may pass through the first guide surface 301 and may be conveyed to the insertion unit 200 along a lower end portion of a guide plate 110 of the guide unit 100 and the printing medium moving along the second guide surface 302 may be conveyed to the insertion unit 200 through a space between the second guide surface 302 and the lower end portion of the guide plate 110.

A more detailed example of the guide unit 100 including the guide plate 110 will be described later.

FIG. 3 is a perspective view illustrating a guide unit, an insertion unit, and conveying guide member illustrated in FIG. 2 according to an example, and FIG. 4 is an exploded perspective view illustrating the guide unit, the insertion unit, and the conveying guide member illustrated in FIG. 3 according to an example.

Hereinafter, a structure of the guide unit 100, the insertion unit 200, and the conveying guide member 300 will be described with reference to FIGS. 3 and 4 according to an example.

Referring to FIGS. 3 and 4, the guide unit 100 may be rotatably provided about the first rotation shaft 211 of the first roller 210 to guide the printing medium moving to the insertion unit 200 from the paper-feed unit 20 and selectively press the first roller 210 toward the second roller 220.

For example, the guide unit 100 may rotate between a first position (see FIGS. 5 to 7A) which presses the first rotation shaft 211 toward the second roller 220 to form a nip between the first roller 210 and the second roller 220 and a second position (see FIG. 7B) which releases the nip.

Hereinafter, for clarity, a position in which the guide unit 100 forms the guide path GP, which guides the printing medium conveyed from the conveying guide member 300 to the insertion unit 200 as illustrated in FIGS. 5 to 7A, may refer to the first position. Also, for clarity, a position in which the guide unit 100 rotates about the first rotation shaft 211 of the first roller 210 in the first position and opens the guide path GP as illustrated in FIG. 7B may refer to the second position.

For example, the guide unit 100 may include the guide plate 110, at least one nip forming member 120 rotatably coupled to the guide plate 110, and at least one elastic member 130 which applies the elastic force to the at least one nip forming member 120.

The guide plate 110 may be rotatably coupled to the first rotation shaft 211 of the first roller 210 and disposed between the insertion unit 200 and the conveying guide member 300 and may guide the printing media conveyed along the first and second guide surfaces 301 and 302 to the insertion unit 200.

For example, the guide plate 110 may be disposed in the upper side of the second guide surface 302 between the insertion unit 200 and the conveying guide member 300 and may form the guide path GP which guides the printing medium conveyed from the paper-feed unit 20 to the insertion unit 200.

The guide plate 110 may include a pair of hook parts 1111 and 1112 disposed at sides thereof and the pair of hook parts 1111 and 1112 may be rotatably coupled to the first rotation shaft 211.

The pair of hook parts 1111 and 1112 may have a hook shape which surrounds the portion of the outer circumferential surface of the first rotation shaft 211.

For example, the pair of hook parts 1111 and 1112 may rotate about the first rotation shaft 211 and may be separated from the first rotation shaft 211.

The at least one nip forming member 120 may be disposed in the upper side of the guide plate 110 and may rotate about the rotation center in parallel to the first rotation shaft 211.

As illustrated in FIGS. 3 and 4, the at least one nip forming member 110 may include a plurality of nip forming members and for example, the guide unit 110 may include first, second, and third nip forming members 121, 122, and 123.

The first to third nip forming members 121 to 123 may be rotatably disposed in the upper side of the guide plate 110 and the first to third nip forming members 121 to 123 may rotate on the guide plate 110 about first to third coupling parts (see 1213, 1223, and 1233 of FIG. 9A) coupled to the guide plate 110.

The first to third nip forming members 121 to 123 may perform a seesaw motion about the first to third coupling parts 1213 to 1233 in the upper side of the guide plate 110.

The first to third coupling parts 1213 and 1233 of the first to third nip forming members 121 to 123 may be rotatably coupled to first to third annular parts 1121, 1122, and 1123 disposed on an upper surface of the guide plate 110. Thus, the first to the third nip forming members 121 to 123 may perform a seesaw motion on the basis of the first to third coupling parts 1213 to 1233.

The first to third nip forming members 121 to 123 may include first to third contact parts 1211, 1221, and 1231 which are formed in one end portions thereof and are in contact with the first rotation shaft 211.

A more detailed example of the first to third nip forming members 121 to 123 will be described later.

First to third elastic members 131, 132, and 133 may be disposed between the first to third nip forming members 121 to 123 and the guide plate 110.

The first to third elastic members 131 to 133 may apply an elastic force to the first to third nip forming members 121 to 123 so that the first to third nip forming members 121 to 123 rotate in a first rotation direction (see C1 of FIG. 6) and press the first rotation shaft 211.

One end of the first to third elastic members 131 to 133 may be coupled to a bottom of another end portion 1212, 1222, and 1232 of the first to third nip forming members 121 to 123 and the other end of the first to third elastic members 131 to 133 may be coupled to first to third protrusions 1141, 1142, and 1143 formed on the upper surface of the guide plate 110.

The first to third elastic members 131 to 133 may be compression springs. For example, the first to third elastic members 131 to 133 may press the first to third nip forming members 121 to 123 upward from the guide plate 110 through the compression springs.

In this example, the first to third nip forming members 121 to 123 may rotate in the first rotation direction C1 on the basis of the first to third coupling parts 1213 to 1233 and press the first rotation shaft 211.

The guide unit 100 may include a coupling plate 140 which couples the other end portions 1212 to 1232 of the first to third nip forming members 121 to 123 to each other.

The insertion unit 200 may include the first and second rollers 210 and 220 as described above.

The first roller 210 may be disposed at an upper side of the second roller 220.

The first roller 210 and the second roller 220 may form the nip through the nip forming member 120 so that the first and second rollers 210 and 220 may insert the printing medium conveyed from the paper-feed unit 20 into the developing unit 40.

The first and second rollers 210 and 220 may include the first and second rotation shafts 211 and 221 and the at least one first and second roller members 212 and 222 rotatably coupled to the first and second rotation shafts 211 and 221.

As illustrated in FIGS. 3 and 4, the first and second roller members 212 and 222 may include pluralities of first and second roller members and the printing medium may pass between the plurality of rotating first roller members 212 and the plurality of rotating second roller members 222 and may be inserted into the developing unit 40.

The above-described nip may be formed between the plurality of first roller members 212 and the plurality of second roller members 222.

The second roller 220 may rotate by receiving a driving force through a separate driving unit (not shown) and the second rotation shaft 221 may be coupled to the driving unit to rotate. The second roller member 222 may be fixed to the second rotation shaft 221 and rotate with the second rotation shaft 221.

The first roller 210 may be in contact with the second roller 220 and rotate through the rotating second roller 220. For example, the first roller member 212 may not be fixed to the first rotation shaft 211 and may be rotatably coupled to the first rotation shaft 211.

The insertion unit 200 may further include a roller bracket 230 which supports the first and second rotation shafts 211 and 221.

The roller bracket 230 may include a pair of supporting parts 2311 and 2312 and a bracket plate 232 which couples the pair of support parts 2311 and 2312 to each other.

The pair of support parts 2311 and 2312 may be coupled to both ends of the first and second rotation shafts 211 and 221.

For example, the pair of support parts 2311 and 2312 may include first rotation shaft holes 2311*a* and 2312*a* to which both ends of the first rotation shaft 211 are coupled and second rotation shaft holes 2311*b* and 2312*b* to which both ends of the second rotation shaft 221 are coupled.

The pair of support parts 2311 and 2312 and the bracket plate 232 may be integrally formed to have a united form.

The conveying guide member 300 may be disposed close to the first and second rollers 210 and 220 and the guide plate 110 may be disposed in the upper side of the conveying guide member 300 in which the second guide surface 302 is formed.

A pair of locking members 311 and 312 may be disposed in upper end portions of the conveying guide member 300.

A pair of locking parts 1131 and 1132 formed in both sides of the guide plate 110 may interface with the pair of locking members 311 and 312 and the pair of locking members 311 and 312 may fix the guide plate 110 through the pair of locking parts 1131 and 1132.

The pair of locking members 311 and 312 may be rotatably coupled onto the conveying guide member 300 and the pair of locking parts 1131 and 1132 may be selectively fixed through the pair of locking members 311 and 312.

The pair of locking members 311 and 312 may include torsion springs (not shown) which apply the elastic force to the pair of locking members 311 and 312 so that the pair of locking members 311 and 312 rotate to a coupling direction with the pair of locking parts 1131 and 1132.

FIG. 5 is a cross-sectional diagram illustrating the guide unit, the insertion unit, and the conveying guide member taken along line I-I of FIG. 3 according to an example, and FIG. 6 is a cross-sectional diagram illustrating the guide unit, the insertion unit, and the conveying guide member taken along line II-II of FIG. 3 according to an example.

Hereinafter, an example structure which forms a nip between the first roller 210 and the second roller 220 in a state in which the guide unit 100 is disposed in a first position will be described with reference to FIGS. 5 and 6.

Referring to FIGS. 5 and 6, the guide plate 110 may be disposed in an upper side of the second guide surface 302 between the insertion unit 200 and the conveying guide member 300 in a state in which the guide unit 100 is located in the first position. Thus, the guide plate 110 may form the guide path GP which guides the printing medium conveyed from the paper-feed unit 20 to the insertion unit 200.

For example, the printing media which pass through the conveying guide member 300 along the first and second conveying paths P1 and P2 may be guided along the bottom of the guide plate 110 and may enter the nip formed between the first roller 210 and the second roller 220.

Front ends 1111*a* and 1112*b* of the pair of hook parts 1111 and 1112 of the guide plate 110 may be supported through the bottom of the bracket plate 232 in a state in which the guide plate 110 is located in the first position.

The pair of locking parts 1131 and 1132 of the guide plate 110 may be locked and fixed to the pair of locking members 311 and 312.

The pair of locking members 311 and 312 may be implemented in various shapes so that the pair of locking parts 1131 and 1132 may interfere with the pair of locking members 311 and 312 and the pair of the locking members 311 and 312 may lock the pair of locking parts 1131 and 1132.

For example, the position of the guide plate 110 may be fixed in the first position through the bracket plate 232 and the pair of locking members 311 and 312 and the upward movement of the guide plate 110 may be limited through the bracket plate 232 and the pair of locking members 311 and 312.

In this example, even in response to the pair of hook parts 1111 and 1112 of the guide plate 110 being rotatably coupled to the first rotation shaft 211, the guide plate 110 may be fixed in the first position through the bracket plate 232 and the pair of locking members 311 and 312 and the rotation of the guide plate 110 about the first rotation shaft 211 may be limited.

The first to the third nip forming members 121 to 123 may include the first to third contact parts 1211 to 1231 which are formed in the one end portions thereof and are in contact with the first rotation shaft 211. The coupling plate 140 may be coupled to the first to third other end portions 1212 to 1232 of the first to third nip forming members 121 to 123 disposed opposite to the first to third contact parts 1211 to 1231.

Hereinafter, for clarity, an example of the first nip forming member 121 illustrated in FIGS. 5 and 6 among the first to third nip forming members 121 to 123 will be mainly described. Example structures of the second and third nip forming members 122 and 123 are substantially the same as that of the first nip forming member 121 illustrated in FIGS. 5 and 6 and a description of the configurations thereof overlapping that of the first nip forming member 121 will be omitted.

Hereinafter, for clarity, the first to third nip forming members 121 to 123 may be collectively referred to as the first nip forming member.

The first contact part 1211 formed in the one end portion of the first nip forming member 121 may be in contact with the portion of the outer circumferential surface of the first rotation shaft 211 and may have a hook shape which surrounds the portion of the outer circumferential surface of the first rotation shaft 211.

For example, the guide plate 110 may rotate about the first rotation shaft 211 through the pair of hook parts 1111 and 1112 and the first nip forming member 121 coupled to the guide plate 110 may also rotate about the first rotation shaft 211 through the first contact part 1211.

In this example, the guide plate 110 and the first nip forming member 121 may rotate about the first rotation shaft 211 between the first position and the second position.

The first nip forming member 121 may rotate about the first coupling part 1213 coupled to the guide plate 110 on the guide plate 110.

The first coupling part 1213 may be disposed between the first other end portion 1212 of the first nip forming member 121 disposed opposite to the first contact part 1211 of the first nip forming member 121 and the first contact part 1211.

For example, the first nip forming member 121 may rotate about the first coupling part 1213 in the upper side of the guide plate 110 and the first contact part 1211 and the other end portion 1212 of the first nip forming member 121 may perform a seesaw motion about the first coupling part 1213.

The seesaw motion may refer to a motion in which the first nip forming member 121 rotates about the first coupling part 1213 in the first rotation direction C1 and in a second rotation direction (see C2 of FIG. 8B) opposite to the first rotation direction C1.

The guide plate 110 may include the first to third annular parts 1121 to 1123 which protrude toward the first to third nip forming members 121 to 123.

The first to third annular parts 1121 to 1123 may be coupled to the first to third coupling parts 1213 to 1233 of the first to third nip forming members 121 to 123 and the first to third coupling parts 1213 to 1233 may be rotatably coupled to the first to the third annular parts 1121 to 1123.

For example, the first to third nip forming members 121 to 123 may rotate about the first to third coupling parts 1213 to 1233 in the upper side of the guide plate 110.

In this example, as illustrated in FIGS. 5 and 6, the first annular part 1121 may be formed to protrude toward the first nip forming member 121 from the upper surface of the guide plate 110 and may include a first insertion hole 1121H into which the first coupling part 1213 of the first nip forming member 121 is rotatably inserted.

The first insertion hole 1121H of the first annular part 1121 may be a hole which is formed to penetrate in the same direction as an axial direction of the first rotation shaft 211 and may have an elongated hole shape extending upward from the guide plate 110.

The first coupling part 1213 of the first nip forming member 121 may include a first insertion protrusion (see 12131 of FIG. 9A) rotatably inserted into the first insertion hole 1121H of the first annular part 1121 and the first nip forming member 121 may rotate about the first insertion protrusion 12131 in the upper side of the guide plate 110.

The first insertion protrusion 12131 may be disposed in an upper end of the elongated hole-shaped first insertion hole 1121H through the elastic force of the first elastic member 131 to be described later and may press the upper end of the first insertion hole 1121H.

The first elastic member 131 may be disposed between the first other end portion 1212 of the first nip forming member 121 and the guide plate 110 and may apply the elastic force to the first other end portion 1212 of the first nip forming member 121 so that the first contact part 1211 of the first nip forming member 121 presses the first rotation shaft 211.

For example, the first nip forming member 121 may rotate about the first coupling part 1213 in the first rotation direction C1 through the elastic force of the first elastic member 131. Thus, the first contact part 1211 of the first nip forming member 121 may press the first rotation shaft 211.

In this example, the nip may be formed between the first roller 210 and the second roller 220.

As described above, the first contact part 1211 may have the hook shape which surrounds the portion of the outer circumferential surface of the first rotation shaft 211. The first contact part 1211 may press the first rotation shaft 211 in a direction facing a center 211C of the first rotation shaft 211 from the portion of the outer circumferential surface of the first rotation shaft 211 surrounded with the first contact part 1211.

As illustrated in FIG. 6, the first contact part 1211 may form the nip between the first roller 210 and the second roller 220 by pressing the first rotation shaft 211 in a first direction D1 facing the second roller 220 in a state in which the guide unit 100 is located in the first location.

For example, the first contact part 1211 of the first nip forming member 121 may press the first rotation shaft 211 in the first direction D1 facing the second roller 220 in a state in which the guide unit 100 is located in the first location. Thus, the nip may be formed between the first roller 210 and the second roller 220. In this example, the front end of the printing medium entering the insertion unit 200 may be aligned through the stopped first and second rollers 210 and 220 and the printing medium may pass through the nip through the rotating first and second rollers 210 and 220 and may be inserted into the developing unit 40.

In this example, the first nip forming member 121 may rotate about the first rotation shaft 211 with the guide plate 110 and the pressing direction of the first rotation shaft 211 through the first contact part 1211 may be changed according to the rotation of the first nip forming member 121 about the first rotation shaft 211.

The above-described example of the first nip forming member 121 may be the same as those of the second and third nip forming members 122 and 123 and the first to third nip forming members 121 to 123 may be rotatably coupled to the upper side of the guide plate 110 and may rotate in the first rotation direction C1 through the first to third elastic members 131 to 133 and press the first rotation shaft 211.

An example structure in which the pressing direction of the first rotation shaft 211 is changed according to the rotation of the first contact part 1211 about the first rotation shaft 211 will be described below.

FIG. 7A is a diagram illustrating an example in which a printing medium entering the insertion unit is caught in a state in which the guide unit is located in a first location and FIG. 7B is a diagram illustrating an example in which the guide unit illustrated in FIG. 7A rotates about the first rotation shaft of the first roller and is located in a second position.

Hereinafter, an example in which a nip between the first roller 210 and the second roller 220 is released by rotating the guide unit 100 about the first rotation shaft 211 will be described with reference to FIGS. 7A and 7B.

Referring to FIG. 7A, the first other end portion 1212 of the first nip forming member 121 may receive an elastic force upward from the first elastic member 131 in a state in which the guide unit 100 is located in the first position and the first contact part 1211 may press the first rotation shaft 211 in the first direction D1 facing the second roller 220.

Accordingly, the first roller 210 and the second roller 220 may form the nip.

However, the printing medium J, which is guided through the conveying guide member 300 and the guide unit 100 and enters the nip, may be jammed in the nip passing process due to various causes such as a state of the orienting medium J and wearing of internal components.

For example, as illustrated in FIG. 7A, the jamming may occur from the front end of the printing medium J in the process that the printing medium J enters between the first roller 210 and the second roller 220.

In this example, as illustrated in FIG. 7B, the nip between the first roller 210 and the second roller 220 may be released by rotating the guide unit 100 about the first rotation shaft 211 and changing the position of the guide unit 100 to the second position. Thus, the jammed printing medium J may be easily removed.

For example, the pair of locking members 311 and 312 may interfere with the pair of locking parts 1131 and 1132. Thus, the guide plate 110 may be maintained in a fixed state. Accordingly, as illustrated in FIG. 7B, the guide plate 110 may rotate the pair of the locking members 311 and 312 and release the fixing of the pair of locking members 311 and 312 to the pair of locking parts 1131 and 1132 and the guide plate 110 may rotate the guide unit 110 to the second position.

As described above, the contact part 1211 of the first nip forming member 121 may have a shape surrounding the portion of the outer circumferential surface of the first rotation shaft 211 and press the rotation shaft 211 in a direction facing the center 211C of the first rotation shaft 211 from the portion of the outer circumferential surface of the first rotation shaft 211 surrounded with the first contact part 1211.

The first contact part 1211 may press the first rotation shaft 211 in the first direction D1 in a state in which the first contact part 1211 is located in the first position and form the nip between the first roller 210 and the second roller 220. The first nip forming member 121 may rotate about the first rotation shaft 211 and the pressing direction of the first rotation shaft 211 by the first contact part 1211 may be changed.

For example, the first nip forming member 121 may rotate by a certain angle about the first rotation shaft 211 in a state in which the first contact part 1211 is located in the first position. Thus, the first contact part 1211 may press the first rotation shaft 211 in a second direction D2 which is rotated by a certain angle about the first rotation shaft 211 from the first direction D1.

In this example, as illustrated in FIG. 7B, the guide unit 100 may rotate by the certain angle about the first rotation shaft 211 and may be located in the second position. Thus, the guide plate 110 and the first nip forming member 121 may also rotate by a certain angle about the first rotation shaft 211 and may be located in the second position.

Accordingly, the portion of the outer circumferential surface of the first rotation shaft 211 surrounded with the first contact part 1211 in the second location may be different from the portion of the outer circumferential surface of the first rotation shaft 211 surrounded with the first contact part 1211 in the first position. The first contact part 1211 in the second position may press the first rotation shaft 211 in the second direction D2 facing the center 211C of the first rotation shaft 211 from the portion of the outer circumferential surface of the first rotation shaft 211 surrounded with the first contact part 1211.

For example, the first contact part 1211 may also press the first rotation shaft 211 in the second direction D2 which is rotated by a certain angle about the first rotation shaft 211.

Accordingly, the second direction D2 may be different from the first direction D1 facing the second roller 220 from the first rotation shaft 211. Thus, the nip between the first roller 210 and the second roller 220 may be released.

The second direction D2 may be rotated by 45 degrees or more, for example, 90 degrees or more about the first rotation shaft 211 from the first direction D1 to release the nip between the first roller 210 and the second roller 220.

Referring to FIG. 7B, the guide plate 110 may open the guide path GP in a state in which the guide plate 110 is located in the second position. For example, the user may further easily remove the jammed printing medium J through the opened guide path GP.

In this example, the guide unit 100 may rotate to the second position about the first rotation shaft 211 and the nip between the first roller 210 and the second roller 220 may be released. Thus, the printing media J, the front end of which is caught by the nip and jammed, may be easily removed on the first and second conveying paths P1 and P2.

FIG. 8A is a diagram illustrating an example in which the printing medium J passing through the insertion unit is caught and FIG. 8B is a diagram illustrating an example in which the coupling plate of FIG. 8A is pressed.

Referring to FIGS. 8A and 8B, a rear end of the printing medium J is caught by the nip and jammed during a process in which the printing medium J passes through the nip formed between the first roller 210 and the second roller 220.

For example, as illustrated in FIG. 8B, the user may press the coupling plate 140 downward to release the nip between the first roller 210 and the second roller 220 and easily remove the jammed printing medium J.

In this example, the first elastic member 131 disposed between the first other end portion 1212 of the first nip forming member 121 and the guide plate 110 may push the first other end portion 1212 of the first nip forming member 121 upward and rotate the first nip forming member 121 in the first rotation direction C1 about the first coupling part 1213. Accordingly, the first contact part 1211 of the first nip forming member 1211 may press the first rotation shaft 211 in the first direction D1 and form the nip between the first roller 210 and the second roller 220.

As illustrated in FIG. 8B, the first other end portion 1212 of the first nip forming member 121 may be pressed in a direction opposite to the direction of the elastic force of the first elastic member 131. Thus, the first nip forming member 121 may rotate about the first coupling part 1213 in the second rotation direction C2 opposite to the first rotation direction C1.

For example, the first contact part 1211 of the first nip forming member 121 may move upward and may be spaced from the first rotation shaft 211.

In this example, the pressing of the rotation shaft 211 through the first nip forming member 121 may be released and the nip between the first roller 210 and the second roller 220 may be released.

The coupling plate 140 may couple the first to third other end portions 1212 to 1232 of the first to third nip forming members 121 to 123 to press the coupling plate 140 and the first to third nip forming members 121 to 123 may simultaneously rotate in the second rotation direction C2. Accordingly, the nip between the first roller 210 and the second roller 220 may be easily released.

The first to third nip forming members 121 to 123 may be separated from the first rotation shaft 211 through the coupling plate 140 and the nip between the first roller 210 and the second roller 220 may be easily released. Thus, the printing medium J, the rear end portion of which is caught by the nip and jammed, may be easily removed on the third conveying path P3.

FIG. 9A is a perspective view illustrating a process of separating the nip forming member from the guide plate illustrated in FIG. 3 according to an example, FIG. 9B is a perspective view illustrating an example in which the nip forming member illustrated in FIG. 9A is separated from the guide plate, FIG. 9C is a cross-sectional diagram illustrating an example in which the guide plate, from which the nip forming member is separated, rotates taken along III-III of FIG. 9B, and FIG. 9D is a cross-sectional diagram illustrating a process of separating the guide plate illustrated in FIG. 9C from the insertion unit according to an example.

Hereinafter, an example in which the guide unit 100 is separated from the insertion unit 200 will be described with reference to FIGS. 9A to 9D.

Referring to FIGS. 9A to 9D, the printing medium conveyed from the paper-feed unit 20 may be jammed in the process of inserting the printing medium into the developing unit 40 through the insertion unit 200 and a portion of the jammed printing medium may be torn in the process of removing the jammed printing medium. The torn portion of the jammed printing medium may be caught between the guide unit 100 and the insertion unit 200 and the removal of the torn portion of the jammed printing medium may be difficult.

The guide unit 100 may be easily separated from the insertion unit 200 and the portion of the printing medium caught between the guide unit 100 and the insertion unit 200 may be easily removed.

As described above, the first to third nip forming members 121 to 123 may include the first to third coupling parts 1213 to 1233 disposed between the first to third contact parts 1211 to 1231 and the first to third other end portions 1212 to 1232.

The first to third coupling parts 1213 to 1233 may be implemented in pairs and the first to third annular parts 1211 to 1123 coupled to the pair of first to third coupling parts 1213 to 1233 may be implemented as a pair of first to third annular parts 1121 to 1123.

As illustrated in FIG. 9A, each of the pair of first coupling parts 1213 may include the first insertion protrusion 12131 and a first locking protrusion 12132 coupled to a distal-end portion of the first insertion protrusion 12131.

The first insertion protrusion 12131 may be rotatably inserted into the elongated hole-shaped first insertion hole 1121H of the first annular part 1121 and may be disposed in the upper end of the first insertion hole 1121H through the elastic force of the first elastic member 131. Thus, the first insertion protrusion 12131 may press the upper end of the first insertion hole 1121H.

The first locking protrusion 12132 may be formed to protrude upward from the distal-end portion of the first insertion protrusion 12131 which passes through the first insertion hole 1121H.

For example, the first annular part 1121 may interfere with the first locking protrusion 12132 in a state in which the first insertion protrusion 12131 is inserted into the first insertion hole 1121H. Thus, the first coupling part 1213 may be rotatably coupled to the first annular part 1121 without deviation from the first insertion hole 1121H.

For example, the first nip forming member 121 may be pressed in a direction opposite to an insertion direction of the first insertion protrusion 12131 into the first insertion hole 1121H in a downwardly pressed state. Thus, the first nip forming member 121 may be separated from the first annular part 1121.

In this example, the first nip forming member 1121 may be pressed downward. Thus, the first insertion protrusion 12131 and the first locking protrusion 12132 disposed in the upper end of the first insertion hole 1121H may move downward along the elongated hole-shaped first insertion hole 1121H.

The interference of the first locking protrusion 12132 with the first annular part 1121 may be released so that the first locking protrusion 12132, with which the first annular part 1121 interferes, may pass through the first insertion hole 1121H.

The first nip forming member 121 may be pressed so as to move in the direction opposite to the insertion direction of the insertion protrusion 12131 into the first insertion hole 1121H. Thus, the first insertion protrusion 12131 and the first locking protrusion 12132 may be separated from the first insertion hole 1121H. Accordingly, the first nip forming member 121 may be separated from the first annular part 1121.

As described above, the first to third nip forming members 121 to 123 may have the same configuration as each other and may also be rotatably coupled to the first to third coupling parts 1213 to 1233.

For example, the user may move the coupling plate 140 and the first to third nip forming members 121 to 123 by pressing the coupling plate 140 downward and pressing the coupling plate 140 in the direction opposite to the insertion direction of the first to third insertion protrusions into the first to third insertion holes and may easily separate the first to third nip forming members 121 to 123 from the guide plate 110.

In this example, as illustrated in FIG. 9B, the first to third nip forming members 121 to 123, the first to third elastic members 131 to 133 coupled to the first to third nip forming members 121 to 123, and the coupling plate 140 coupling the first to third nip forming members 121 to 123 may be separated from the guide plate 110.

As illustrated in FIG. 9C, the guide plate 110, from which the first to third nip forming members 121 to 123 are separated, may be rotated about the first rotation shaft 211 from the first position to the second position.

For clarity, an example in which the guide plate 110 located in the first position is illustrated with the guide plate 110 which rotates about the first rotation shaft 211 toward the second position and the locking member 312 rotates to fix the guide plate 110 or release the fixing of the guide plate 100 has been illustrated in FIG. 9C.

The pair of locking members 311 and 312 may interfere with the pair of locking parts 1131 and 1132 in a state in which the guide plate 110 is located in the first position. Thus, the first guide plate 110 may be maintained in the fixed state. Accordingly, the first guide plate 110 may release the fixing of the pair of locking parts 1131 and 1132 by rotating the pair of locking parts 311 and 312 and the guide plate 110 may be rotated toward the second position.

As the guide plate 110 is rotated toward the second position, the support of the distal-end portions 1111*a* and 1112*a* of the pair of hook parts 1111 and 1112 of the guide plate 110 from the bracket plate 232 may be released.

For example, as illustrated in FIG. 9D, the guide plate 110 may be separated from the first rotation shaft 211 and may be separated from the insertion unit 200 between the bottom of the bracket plate 232 and the first rotation shaft 211.

In this example, the guide unit 100 may press the coupling plate 140 downward and press the coupling plate 140 in the direction opposite to the insertion direction of the first to third insertion protrusions into the first to third insertion holes. Thus, the first to third nip forming members 121 to 123 may be easily separated from the guide plate 110.

The guide plate 110 may be rotated about the first rotation shaft 211 from the first position toward the second rotation. Thus, the guide plate 110 may be easily separated from the first rotation shaft 211.

For example, the guide unit 100 may be separated from the insertion unit 200 and the portion of the printing medium caught between the guide unit 100 and the insertion unit 200 may be easily removed.

In this example, the guide unit 100 may be provided to form the nip between the first roller 210 and the second roller 220 and simultaneously to rotate from the first rotation shaft 211. Thus, the nip between the first roller 210 and the second roller 220 may be selectively formed and released. Through the simple structure for rotating the guide unit 100, the nip may be formed between the first roller 210 and the second roller 220 or the jammed printing medium may be easily removed.

The nip between the first roller 210 and the second roller 220 may be easily released by pressing the coupling plate 140 which couples the other end portions 1212 to 1232 of the plurality of nip forming members 121 to 123. Thus, the jammed printing medium may be easily removed.

The guide unit 100 may be easily separated by sequentially separating the first to third nip forming members 121 to 123 and the guide plate 110 from the first rotation shaft 211 and the torn portion of the printing medium caught between the guide unit 100 and the insertion unit 200 may be easily removed.

The various examples have been described above individually. However, the various examples may be implemented by combining the configuration and operation of each example with at least one other example.

The foregoing examples and advantages are not to be construed as limiting the present disclosure. The present disclosure can be readily applied to other types of apparatuses. Also, the description of the examples of the present disclosure is intended to be illustrative, and not to limit the scope of the claims, and many alternatives, modifications, and variations will be apparent to those skilled in the art.

The invention claimed is:

1. An image forming apparatus comprising:

a paper-feed unit;

a developing unit to form an image in a printing medium;

an insertion unit including a first roller and a second roller to insert the printing medium conveyed from the paper-feed unit into the developing unit; and a guide unit to guide the printing medium to the insertion unit and rotatably disposed about a rotation shaft of the first roller to selectively press the first roller to the second roller, the guide unit including:

a guide plate, rotatably coupled to the rotation shaft, to guide the printing medium to the insertion unit;

a nip forming member, including a contact part located at one end portion thereof to contact the rotation shaft, disposed in an upper side of the guide plate, and rotatably coupled to the guide plate to rotate about a rotation center, the rotation center located on the guide plate in parallel to the rotation shaft;

a coupling part coupled to the guide plate and disposed between another end portion of the nip forming member disposed in an opposite side of the contact part and the contact part, wherein the nip forming member is rotatable about the coupling part; and an elastic member, disposed between the other end portion of the nip forming member and the guide plate, to apply an elastic force to the other end portion of the nip forming member so that the nip forming member rotates in a first rotation direction and the contact part presses the rotation shaft.

2. The image forming apparatus as claimed in claim 1, wherein the guide unit is rotatable between a first position, which presses the rotation shaft of the first roller toward the second roller to form a nip between the first roller and the second roller, and a second position which releases the nip.

3. The image forming apparatus as claimed in claim 2, wherein the nip forming member is rotatable about the rotation shaft with the guide plate, and wherein a direction in which the contact part presses the rotation shaft is changed in response to rotation of the nip forming member about the rotation shaft.

4. The image forming apparatus as claimed in claim 3, wherein the contact part is to contact a portion of an outer circumferential surface of the rotation shaft to press the rotation shaft toward a center of the rotation shaft from the portion of the outer circumferential surface of the rotation shaft.

5. The image forming apparatus as claimed in claim 4, wherein the contact part has a hook shape to surround the portion of the outer circumferential surface of the rotation shaft.

6. The image forming apparatus as claimed in claim 3, wherein the contact part is to press the rotation shaft in a first direction facing the second roller in a state in which the guide unit is located in the first position and is to release the nip in a state in which the guide unit is located in the second position.

7. The image forming apparatus as claimed in claim 6, wherein the contact part is to press the rotation shaft of the first roller toward a second direction which is rotated by a certain angle about the rotation shaft from the first direction in response to the nip forming member being rotated by a certain angle about the rotation shaft.

8. The image forming apparatus as claimed in claim 1, wherein the nip forming member includes:

a first nip forming member;

a second nip forming member; and a third nip forming member, wherein the guide unit further includes a coupling plate to couple other end portions of the first to third nip forming members, and wherein the first to third nip forming members are to rotate in a second rotation direction opposite to the first rotation direction in response to pressing of the coupling plate to be separated from the rotation shaft.

9. The image forming apparatus as claimed in claim 1, wherein the guide plate includes an annular part which protrudes toward the nip forming member and includes an insertion hole to penetrate in the same direction as an axis direction of the rotation shaft, wherein the coupling part includes an insertion protrusion rotatably inserted into the insertion hole, and wherein the nip forming member is to rotate about the insertion protrusion.

10. The image forming apparatus as claimed in claim 9, wherein the insertion hole has an elongated hole shape extending upward from the guide plate, and wherein the insertion protrusion is disposed in an upper end of the insertion hole through an elastic force of the elastic member and is to press the upper end of the insertion hole.

11. The image forming apparatus as claimed in claim 2, wherein the guide plate forms a guide path to guide the printing medium to the insertion unit in a state in which the guide unit is located in the first position and is to open the guide path in a state in which the guide unit is located in the second position.

12. The image forming apparatus as claimed in claim 11, wherein the guide plate includes a hook part rotatably coupled to the rotation shaft, and wherein the hook part surrounds a portion of an outer circumferential surface of the rotation shaft.

13. A printing medium guide comprising:

an insertion unit including a first roller and a second roller; and a guide unit rotatably disposed about a rotation shaft of the first roller to press the first roller to the second roller, the guide unit including:

a guide plate rotatably coupled to the rotation shaft;

a nip forming member, including a contact part located in one end portion thereof to contact the rotation shaft, rotatably coupled to an upper side of the guide plate to rotate about a rotation center, the rotation center located on the guide plate in parallel to the rotation shaft;

a coupling part disposed between another end portion of the nip forming member disposed in an opposite side of the contact part and the contact part and coupled to the guide plate, wherein the nip forming member is rotatable about the coupling part; and an elastic member, disposed between the other end portion of the nip forming member and the guide plate, to apply an elastic force to the other end portion of the nip forming member so that the nip forming member rotates in a first rotation direction and the contact part presses the rotation shaft.

14. The printing medium guide of claim 13, wherein the guide unit is rotatable between a first position, which presses the rotation shaft of the first roller toward the second roller to form a nip between the first roller and the second roller, and a second position which releases the nip.

15. The printing medium guide of claim 13, wherein the nip forming member is rotatable about the rotation shaft with the guide plate, and wherein a direction in which the contact part presses the rotation shaft is changed in response to rotation of the nip forming member about the rotation shaft.

16. The printing medium guide of claim 15, wherein the contact part is to contact a portion of an outer circumferential surface of the rotation shaft to press the rotation shaft toward a center of the rotation shaft from the portion of the outer circumferential surface of the rotation shaft.

17. The printing medium guide of claim 16, wherein the contact part has a hook shape to surround the portion of the outer circumferential surface of the rotation shaft.

18. The printing medium guide of claim 14, wherein the contact part is to press the rotation shaft in a first direction facing the second roller in a state in which the guide unit is located in the first position and is to release the nip in a state in which the guide unit is located in the second position.

19. The printing medium guide of claim 18, wherein the contact part is to press the rotation shaft of the first roller toward a second direction which is rotated by a certain angle about the rotation shaft from the first direction in response to the nip forming member being rotated by a certain angle about the rotation shaft.

20. The printing medium guide of claim 13, wherein the nip forming member includes:

a first nip forming member;

a second nip forming member; and a third nip forming member, wherein the guide unit further includes a coupling plate to couple other end portions of the first to third nip forming members, and wherein the first to third nip forming members are to rotate in a second rotation direction opposite to the first rotation direction in response to pressing of the coupling plate to be separated from the rotation shaft.

* * * * *